US006851461B2

(12) United States Patent
McNicol et al.

(10) Patent No.: US 6,851,461 B2
(45) Date of Patent: Feb. 8, 2005

(54) APPARATUS FOR DEBARKING LOGS WITH REVERSIBLE ROTATION FOR VARYING THE RATE OF DEBARKING

(75) Inventors: Robert Michael McNicol, Mission (CA); Michael Poropat, Surrey (CA)

(73) Assignee: Carmanah Design and Manufacturing, Vancouver ( * ) Notice: Subject to any disclaimer, the term of this patent is extended or adjusted under 35 U.S.C. 154(b) by 0 days.

(21) Appl. No.: 10/194,696

(22) Filed: Jul. 12, 2002

(65) Prior Publication Data

US 2004/0007288 A1 Jan. 15, 2004

(51) Int. Cl.[7] ..... B27L 1/05
(52) U.S. Cl. ..... 144/208.9; 241/178
(58) Field of Search ..... 144/208.9, 208.1, 144/341, 340; 241/181, 178, 208.4, 208.5

(56) References Cited

U.S. PATENT DOCUMENTS 1,324,193 A * 12/1919 Guettler ..... 144/208.9
2,592,054 A * 4/1952 Mertz et al. ..... 144/208.9
2,712,330 A * 7/1955 Thompson ..... 144/208.9
3,190,327 A 6/1965 Robbins
3,807,469 A * 4/1974 Schnyder ..... 144/341
3,862,653 A 1/1975 Fay et al.
3,863,692 A 2/1975 Hasada
4,691,750 A 9/1987 Nakajima
4,771,953 A 9/1988 Morey
5,070,919 A 12/1991 Ackerman
5,117,881 A 6/1992 Simpson
5,390,866 A * 2/1995 Kochnev et al. ..... 241/181
5,896,901 A 4/1999 Lacroix
6,578,609 B1 * 6/2003 McNicol et al. ..... 144/208.9

* cited by examiner

*Primary Examiner*—Allen Ostrager
*Assistant Examiner*—Shelley Self
(74) *Attorney, Agent, or Firm*—Fulwider Patton Lee & Utecht, LLP

(57) ABSTRACT

Apparatus for debarking logs including a drum mounted for rotation about an axis to define an inner drum surface. Debarking apparatus is provided on the inner surface configurable to debark logs within the drum at a first rate on rotation of the drum in a first direction and at a second rate when the drum is rotated in a second direction.

26 Claims, 4 Drawing Sheets

APPARATUS FOR DEBARKING LOGS WITH REVERSIBLE ROTATION FOR VARYING THE RATE OF DEBARKING

FIELD OF THE INVENTION

This invention relates to apparatus for removing bark from raw logs, and, more particularly, to a drum type debarker with variable debarking action.

BACKGROUND OF THE INVENTION

Debarking equipment for removing bark from logs prior to additional processing by other wood processing equipment is well known. Examples of prior art debarking equipment known to the inventors includes the following patents:

U.S. Pat. No. 3,190,327 to Robbins

U.S. Pat. No. 3,862,653 to Fay et al.

U.S. Pat. No. 3,863,692 to Hasada et al.

U.S. Pat. No. 4,691,750 to Nakajima

U.S. Pat. No. 4,771,953 to Morey

U.S. Pat. No. 5,070,919 to Ackerman; and

U.S. Pat. No. 5,117,881 to Simpson

Many existing designs for debarking equipment rely on a drum arrangement into which logs to be debarked are fed. The drum is mounted for rotation about a generally horizontal, longitudinal axis and the inner surface of the drum has a sequence of longitudinal flights or ridges that run parallel to the axis of rotation. As the drum is rotated, the flights act to carry the logs to an elevated position where they are dropped due to gravity to make contact with other logs and lower flights which act to remove bark from the logs by abrasion.

The rate at which logs are debarked in a drum-type debarker depends on various factors including log condition, log diameter, temperature, and log species which all affect the adherence of the bark to the underlying wood.

Conventional drum-type debarking equipment suffers from the disadvantage that it is limited in its ability to control and vary the rate of debarking. When conditions are such that bark is easily removed from a batch of logs, the residence time of the logs in the drum until the bark is removed is reduced. If a batch of logs has bark that is more difficult to remove, the residence time has to be increased. In some equipment, the drum can be rotated at different speeds. A slower rotation speed accommodates logs with easily removed bark while a faster speed tends to debark more difficult logs with approximately the same residence time.

SUMMARY OF THE INVENTION

The present invention provides debarking equipment that allows for variation in the rate of debarking by rotating the drum in different directions. The choice of rotation direction on the desired aggressiveness of debarking. When the debarking requirement is easy, the drum is rotated in one direction such that debarking is achieved in a substantially conventional manner by log to log contact and contact with the drum walls and flights. As conditions change and the bark is more difficult to remove, the drum is rotated in the opposite direction to expose an additional abrasive debarking element.

Accordingly, the present invention provides apparatus for debarking a log comprising:

a drum mounted for rotation about an axis and having a inner surface;

debarking apparatus on the inner surface configurable to debark a log within the drum at a first rate on rotation of the drum in a first direction and at a second rate when the drum is rotated in a second direction.

The debarking apparatus of the present invention preferably comprises a pivotable plate with an abrasive surface that is exposed or concealed depending on the direction of rotation. In an alternative arrangement, the debarking apparatus includes a movable cover that acts to cover or expose a fixed abrasive surface depending on the direction of rotation.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
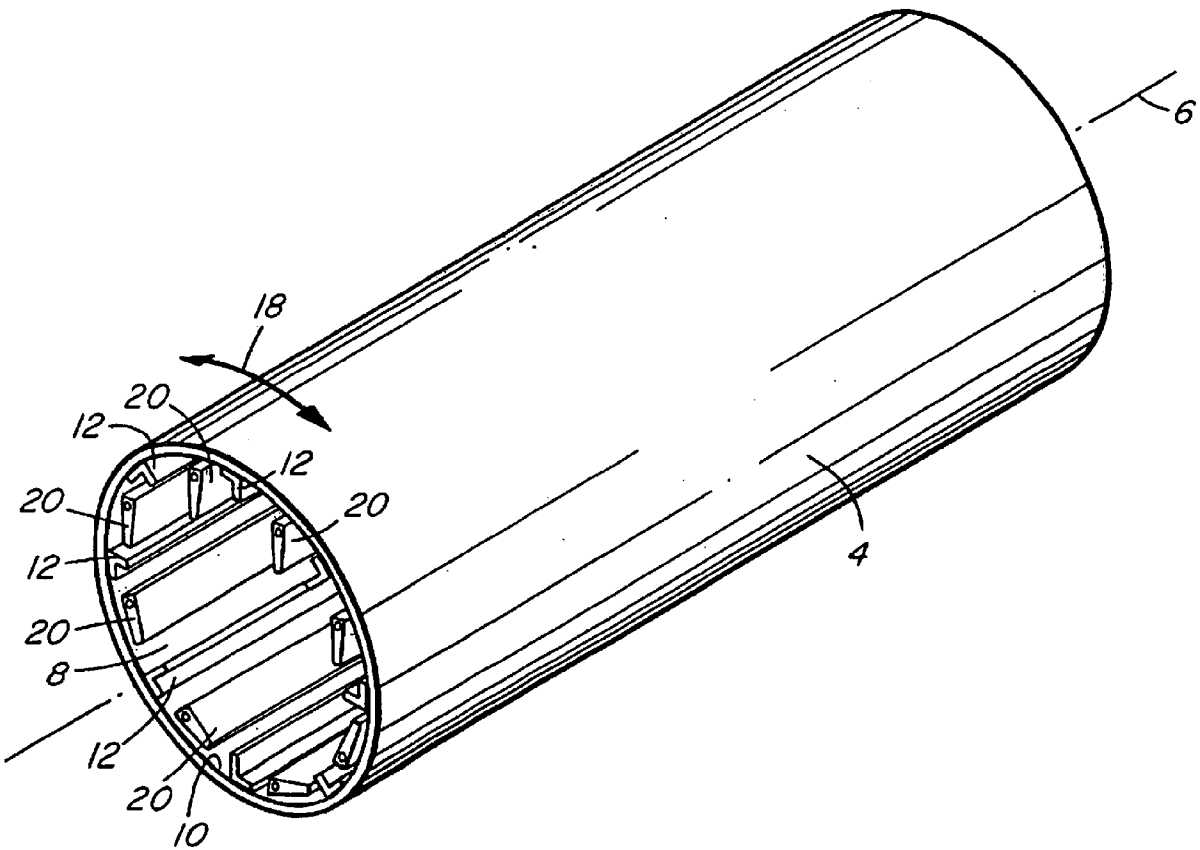
FIG. 1 is a schematic view of a drum-type debarker according to the first embodiment of the present invention.

Referring to FIG. 1, there is shown a drum-type debarker 2 according to the present invention. Drum 4 is mounted for rotation about an axis 6 and is formed with a hollow interior 8. Logs requiring debarking are introduced into interior 8 and exit from the drum at the end of the process. As is conventional, the inner surface 10 of drum 4 preferably includes a plurality of stationary projections or flights 12 extending generally parallel to the axis of rotation 6 and extending radially inwardly into interior 8 of the drum. In the illustrated embodiments, flights 12 are shown with a generally L-shaped cross-section. It will be apparent to those skilled in the art that alternative flights are possible. Flights having a substantially triangular or dome shaped cross-section are known in conventional debarking equipment and will function adequately with the equipment of the present invention.

Flights 12 are spaced about inner surface 10 and act to lift and drop logs introduced into drum interior 8 as the drum is rotated about axis 6. The debarking equipment of the present invention also includes additional debarking apparatus 20 on inner surface 10 configurable to debark logs at different rates depending on the direction of rotation of drum 4 as indicated by arrow 18. When drum 4 is rotated, for example, counterclockwise, logs are debarked at a first rate and when drum 4 is rotated in the opposite clockwise direction, logs are debarked at a second rate. In other words, the debarking equipment of the present invention works on the principle that a reversible drum in conjunction with debarking apparatus 20 allows the operator to vary the rate of debarking as required.

Figure 1A:
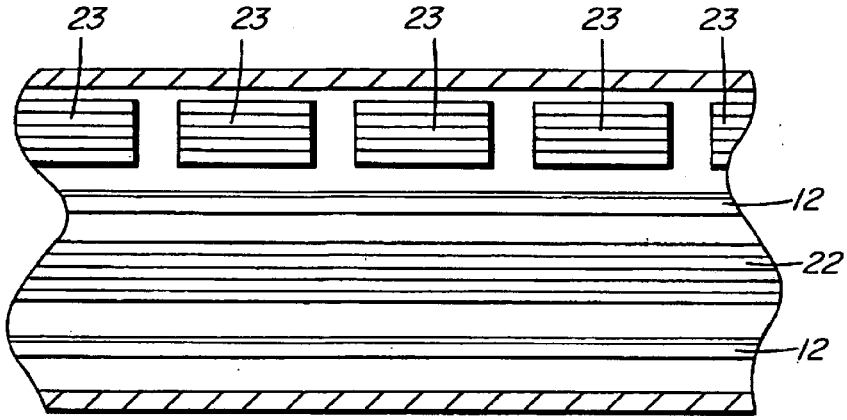
FIG. 1*a* is a schematic view of different debarking plate configurations.
Figure 2:
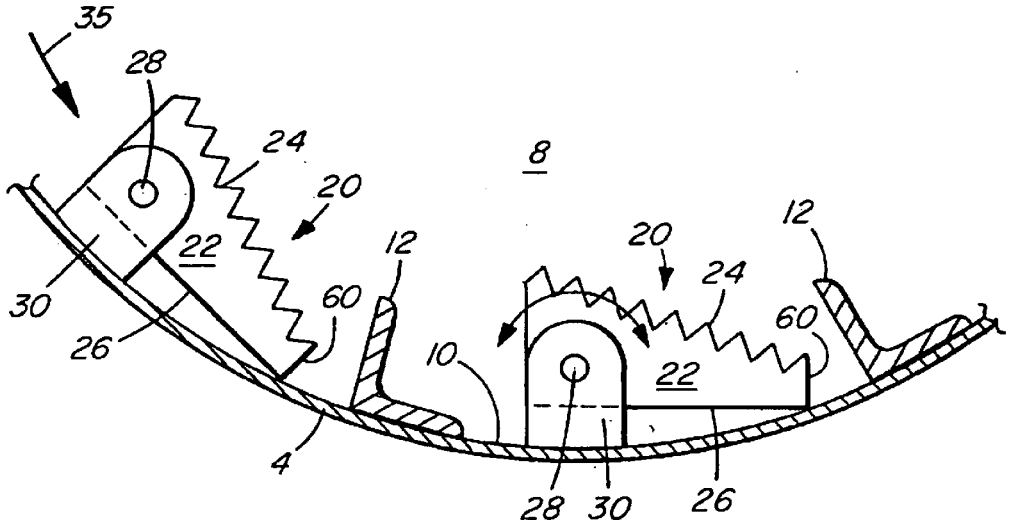
FIG. 2 is a detail section view of the first embodiment in which the debarking plates are pivoted by rotation of the drum in a first direction to debark at a high rate.
Figure 3:
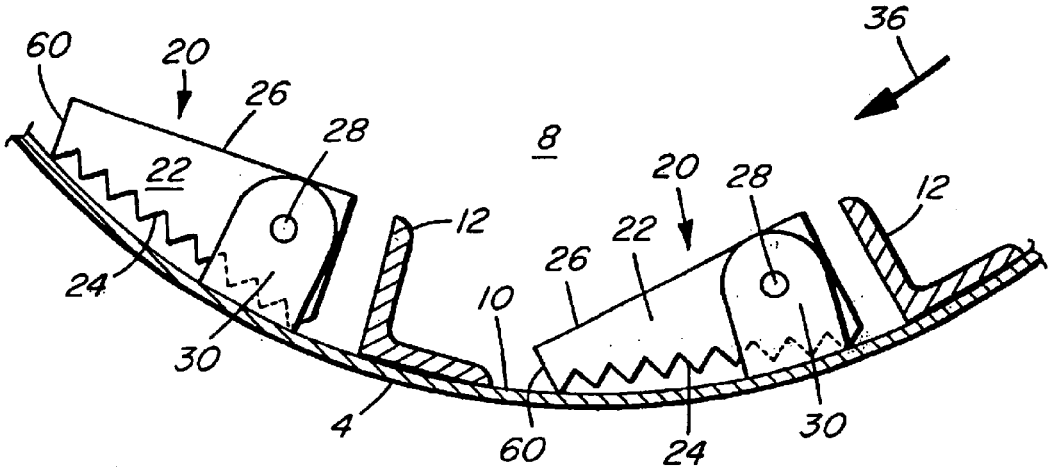
FIG. 3 is a detail section view of the embodiment of FIGS. 1 and 2 with the debarking plates pivoted by rotation of the drum in the opposite direction to debark at a lower rate.

FIGS. 2 to 6 show representative partial cross-sections through drum 4, and provide details of various embodiments of preferred debarking apparatus according to the present invention. In each embodiment, debarking apparatus 20 comprises at least one projection adjacent inner surface 10 having a first surface to debark logs that come into contact with the first surface at an increased rate. Preferably, the at least one projection comprises a debarking plate 22 having a first surface in the form of a serrated or saw-like edge 24 for aggressive debarking, however, any projection having an abrasive surface can be used. Each debarking plate 22 preferably runs along the length of the inner surface 10 of drum 4 and is positioned between flights 12. Debarking plates 22 can be positioned between each pair of adjacent flights 12 or between only selected flights preferably in a regular pattern. In addition, debarking plates 22 can extend the entire length of drum 4 or be formed as a series of discrete, spaced units 23 extending along the drum as best shown in FIG 1*a*.

Debarking plates 22 are mounted to inner surface 10 of drum 4 and configured to allow serrated edge 24 to make contact with logs when the drum is rotated in a first direction and configured to eliminate or at least minimize the participation of the serrated edge 24 in the debarking process when the drum is rotated in a second direction as will be explained in more detail below.

FIGS. 1 to 4 show a first embodiment of the invention in which the debarking plates 22 are mounted to the inner surface 10 of drum 4 for pivoting movement. In addition to having an abrasive or serrated edge 24, each debarking plate 22 has a second surface or edge 26 opposite edge 24 that is substantially flat and is designed to debark logs at a second rate that is less than the rate of debarking of edge 24. In the arrangement illustrated, plate 22 is hinged via a pivot pin 28 attached to at least one clevis arm 30 extending from inner surface 10 of drum 4. Preferably, multiple clevis arms 30 will pivotally support a debarking plate 22 extending substantially the length of the drum. In the case of multiple, discrete plates 22, there is a clevis arm 30 associated with each plate. Other pivoting arrangements are possible as long as the debarking plate is free to pivot according to the direction of rotation of the drum 4.

Figure 4:
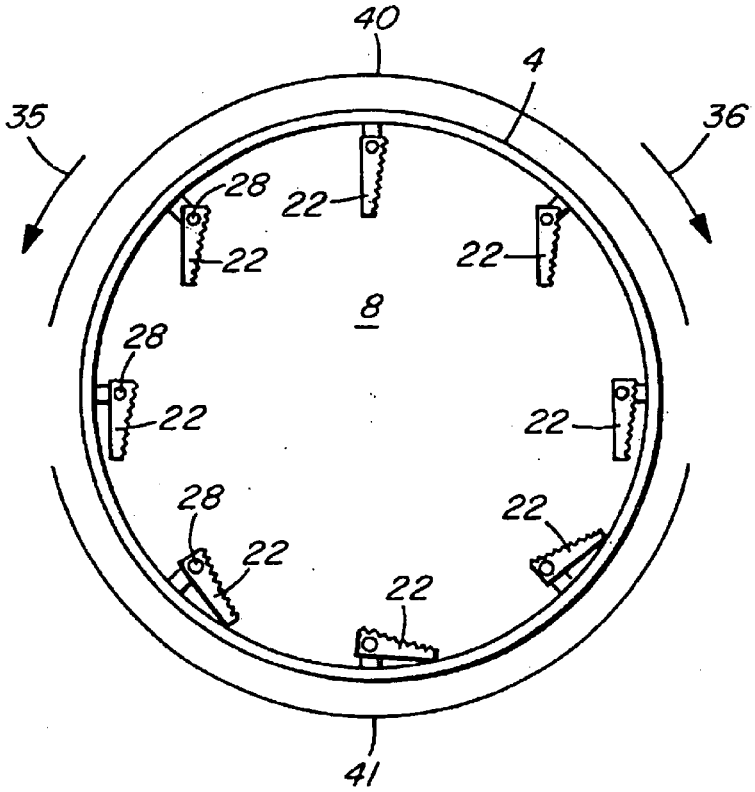
FIG. 4 is a schematic view showing the manner in which the debarking plates hang as the drum rotates.

Pivot pin 28 and debarking plate 22 are interconnected such that either abrasive surfaces 24 or substantially flat surface 26 of plate 22 will be rotated for exposure depending on the direction of rotation of drum 10. This pivoting action is illustrated in FIG. 4. At the upper periphery 40 of the drum, the debarking plates 22 hang generally downwardly toward the axis of rotation 6 of the drum due to gravity. The direction of rotation of drum 4 determines which way the plates pivot about pin 28 and which surface of the plate is facing upwardly and inwardly at the bottom periphery of the drum where debarking occurs. For example in the illustrated embodiment, when drum 4 is rotated in a first, counterclockwise direction as indicated by arrow 35 in FIG. 2, abrasive surface 24 of each plate 22 is exposed at the lower periphery 41 of the drum due to plate 22 pivoting about pin 28 due to gravity. Logs that come into contact with surface 24 are thereby debarked at an increased rate. Similarly, when drum 4 is rotated in the opposite, clockwise direction as illustrated by arrow 36 in FIG. 3, substantially flat surface 26 is exposed at the lower periphery 41 of the drum by pivoting of plate 22 about pin 28. By placing abrasive surface 24 and substantially flat surface 26 on opposite sides of debarking plate 22, the plate is designed to minimize contact between logs and the abrasive surface when drum 4 is rotated in the clockwise direction.

Figure 5:
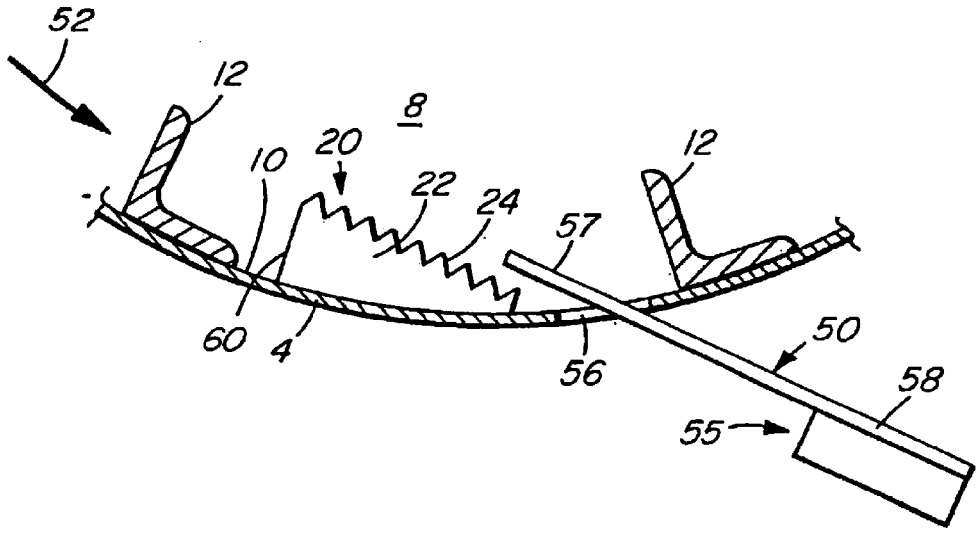
FIG. 5 is a detail section view of a second embodiment in which the debarking plates are exposed from beneath associated covers by virtue of rotation of the drum in a first direction to debark at a high rate.
Figure 6:
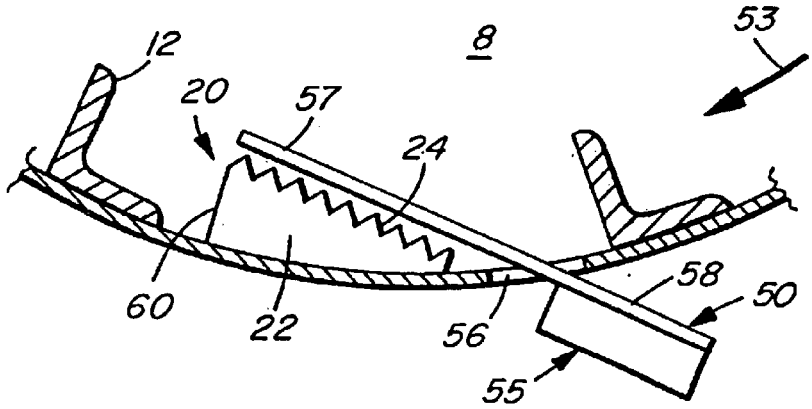
FIG. 6 is a detail section view of the embodiment of FIG. 5 in which the debarking plates are covered due to rotation of the drum in the opposite direction to debark at a lower rate.

FIGS. 5 and 6 show a debarker according to another embodiment of the present invention which also relies on reversing the direction of rotation of the drum to control the rate of debarking. In the illustrated embodiment, the inner surface 10 of drum 4 is formed with at least one projection in the form of a debarking plate 22 that is fixed in place with an abrasive surface 24 that faces into the interior 8 of drum 4. A blocking surface in the form of movable plate 50 is provided to expose or cover the fixed abrasive surface 24 depending on the direction of rotation of the drum. Preferably, the movable plate 50 is mounted at the exterior of drum 4 and has an exterior portion 58 that remains external to the drum and an interior portion 57 that extends through a slot 56 in the drum into interior 8 of the drum to cover abrasive plate 24.

Movable plate 50 is slidable between a first position shown in FIG. 5 to expose the abrasive surface 24 when drum 4 is rotated in a first counterclockwise direction (shown by arrow 52) and a second position shown in FIG. 6 to cover the abrasive surface when the drum is rotated in the opposite direction (shown by arrow 53).

The operation of movable plate 50 is controlled by an activation system to urge the plate to the appropriate position based on the direction of rotation. In a preferred arrangement, the activation system involves weighting of the movable plate 50 to slid to the exposing or covering position due to gravity on rotation of the drum. Movable plate 50 includes a counter-weight 55 affixed to the exterior portion 58 of movable plate 50.

The illustrated embodiments of show the debarking plates 22 of the present invention positioned between conventional debarking flights 12 which act to lift and drop the logs, and which also server to debark logs that come into contact with the flights. It is intended that the debarking equipment of the present invention can be constructed without conventional flights 12. In such an arrangement, the radially inwardly extending edge surfaces 60 and the abrasive debarking surface 24 itself (when exposed) of debarking plates 22 will act as a engaging surface to lift logs with rotation of the drum for subsequent dropping to the lower periphery of the drum where the debarking action occurs.

Although the present invention has been described in some detail by way of example for purposes of clarity and understanding, it will be apparent that certain changes and modifications may be practised within the scope of the appended claims.

We claim:

1. Apparatus for debarking a log comprising:

a drum mounted for rotation about an axis and having an inner surface defining an interior to receive logs for debarking;

a drive system to rotate the drum in one of a first and second direction; and debarking apparatus on the inner surface configurable by the direction of rotation of the drum comprising at least one projection having a first surface for debarking logs that come into contact with the first surface at a first rate, the first surface being exposed when the drum is rotated in the first direction and the first surface being concealed when the drum is rotated in the second direction for debarking logs at a second rate.

2. Apparatus as claimed in claim 1 in which the at least one projection includes a second surface to debark logs that come into contact with the second surface at the second rate, the second surface being exposed when the drum is rotated in the second direction and the second rate being less than the first rate.

3. Apparatus as claimed in claim 2 in which the at least one projection is configured to minimize contact between the log and the first surface when the drum is rotated in the second direction.

4. Apparatus as claimed in claim 1 in which the drum includes a plurality of additional stationary projections extending on the inner surface generally parallel to the axis of rotation to debark logs that come into contact with the stationary projections.

5. Apparatus as claimed in claim 1 in which the at least one projection comprises a plate pivotally connected to the inner surface, the plate having first and second surfaces whereby rotation of the drum in the first direction pivots the plate to expose the first surface and rotation of the drum in the second direction pivots the plate to expose the second surface.

6. Apparatus as claimed in claim 5 wherein the plate is hinged to said inner surface by a pivot pin attached to a clevis arm.

7. Apparatus as claimed in claim 5 in which the first surface comprises a serrated edge of the plate and the second surface comprises a substantially flat edge of the plate.

8. Apparatus as claimed in claim 7 in which the serrated edge is opposite the substantially flat edge.

9. Apparatus as claimed in claim 1 in which the at least one projection is fixed and the drum includes a blocking surface movable between a first position to expose the first surface when the drum is rotated in the first direction and a second position to cover the first surface when the drum is rotated in the second direction.

10. Apparatus as claimed in claim 9 in which the blocking surface comprises a plate which is weighted to move to the first position when the drum is rotated in the first direction and to the second position when the drum is rotated in the second direction.

11. Apparatus as claimed in claim 10 in which the plate is mounted at the exterior of the drum and extends through a slot in the drum into the interior of the drum.

12. Apparatus as claimed in claim 11 in which the exterior end of the plate is formed with a counterweight.

13. Apparatus as claimed in claim 9 in which the first surface of the projection is formed with a serrated edge.

14. Apparatus as claimed in claim 1 in which the at least one projection is mounted to the inner surface of the drum and the drum includes a movable cover slidably mounted to the drum and moveable between an exposing position in which the first surface of the at least one projection is exposed to permit contact between the first surface and the log, and a covering position in which the first surface is covered to minimize contact between the first surface and the log; and an actuating system to urge the movable cover to the exposed position when the drum is rotated in the first direction and to urge the movable cover to the covering position when the drum is rotated in the second direction.

15. Apparatus as claimed in claim 14 in which the actuating system comprises a weight on the movable cover to displace the cover between exposed and covering positions due to gravity.

16. Apparatus as claimed in claim 14 in which the drum includes a plurality of stationary projections extending on the inner surface generally parallel to the axis of rotation to debark logs that come into contact with the stationary projections at the second rate.

17. Apparatus as claimed in claim 14 in which the at least one plate is fixed.

18. Apparatus as claimed in claim 15 in which the movable cover is positioned at the at the exterior of the drum and extends through a slot in the drum into the interior of the drum.

19. Apparatus as claimed in claim 18 in which the movable cover is a plate having an end exterior to the inner surface of the drum formed with the weight.

20. Apparatus as claimed in claim 14 in which the first surface of the at least one plate is formed with a serrated edge.

21. Apparatus for debarking a log comprising:

a drum mounted for rotation about an axis and having a inner surface defining an interior to receive logs for debarking;

drive means for rotating the drum in one of a first and second direction; and debarking means associated with the inner surface configurable by the direction of rotation of the drum for debarking a log within the interior of the drum at a first rate on rotation of the drum in the first direction and at a second rate when the drum is rotated in the second direction.

22. Apparatus as claimed in claim 21 in which the debarking means comprises at least one projection at the inner surface having a first surface to debark logs that come into contact with the first surface at the first rate, the first surface being exposed when the drum is rotated in the first direction.

23. Apparatus for debarking a log comprising:

a drum mounted for rotation about an axis and having a inner surface defining an interior to receive logs for debarking;

a drive system to rotate the drum in first and second directions; and debarking apparatus on the inner surface configurable to debark a log within the interior of the drum at a first rate on rotation of the drum in the first direction and at a second rate when the drum is rotated in the second direction, the debarking apparatus comprising a plate pivotally connected to the inner surface, the plate having first and second surfaces whereby rotation of the drum in the first direction pivots the plate to expose the first surface and rotation of the drum in the second direction pivots the plate to expose the second surface.

24. Apparatus as claimed in claim 23 wherein the plate is hinged to said inner surface by a pivot pin attached to a clevis arm.

25. Apparatus as claimed in claim 23 in which the first surface comprises a serrated edge of the plate and the second surface comprises a substantially flat edge of the plate.

26. Apparatus as claimed in claim 25 in which the serrated edge is opposite the substantially flat edge.

* * * * *

UNITED STATES PATENT AND TRADEMARK OFFICE

CERTIFICATE OF CORRECTION

PATENT NO. : 6,851,461 B2 
DATED : February 8, 2005
INVENTOR(S) : Robert Michael McNicol and Michael Poropat It is certified that error appears in the above-identified patent and that said Letters Patent is hereby corrected as shown below:

Column 1,
Line 56, delete "on the desired" and insert -- depends on the desired --.

Column 4,
Line 33, after "illustrated embodiments" delete "of".
Line 36, delete "server" and insert -- serves --.
Line 42, delete "act as a" and insert -- act as an --.

Column 6,
Line 11, delete the first occurrence of "at the".

Signed and Sealed this

Nineteenth Day of July, 2005

JON W. DUDAS
*Director of the United States Patent and Trademark Office*